US006593694B1

(12) United States Patent
Ikeuchi

(10) Patent No.: US 6,593,694 B1
(45) Date of Patent: Jul. 15, 2003

(54) DISCHARGE LAMP WITH LOWER HIGH TEMPERATURE VISCOSITY OUTER PORTION AND METHOD FOR MAKING SAME

(75) Inventor: Mituru Ikeuchi, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/423,652

(22) PCT Filed: Mar. 16, 1999

(86) PCT No.: PCT/JP99/01274

§ 371 (c)(1),
(2), (4) Date: Jan. 13, 2000

(87) PCT Pub. No.: WO99/49497

PCT Pub. Date: Sep. 30, 1999

(30) Foreign Application Priority Data

Mar. 20, 1998 (JP) ..... 10-072604

(51) Int. Cl.[7] ..... H01J 17/16

(52) U.S. Cl. ..... 313/635; 313/636; 445/26; 445/58; 427/106; 65/32.4; 65/155; 65/60.1; 65/60.5

(58) Field of Search ..... 313/112, 113, 313/636, 634, 635; 445/26, 58; 359/885, 890, 891; 427/106; 65/32.4, 30.12, 138, 155, 60.1, 60.5

(56) References Cited

U.S. PATENT DOCUMENTS

| | | | | | |
|---|---|---|---|---|---|
| 3,390,298 | A | * | 6/1968 | Werner | 313/636 |
| 3,531,677 | A | * | 9/1970 | Loughridge | 313/112 |
| 3,851,200 | A | * | 11/1974 | Thomasson | 313/113 |
| 4,225,635 | A | * | 9/1980 | Yoldas | 427/106 |
| 5,051,650 | A | * | 9/1991 | Taya et al. | 313/112 |

FOREIGN PATENT DOCUMENTS

| | | | |
|---|---|---|---|
| JP | 8-36993 | 2/1996 | H01J/61/35 |

* cited by examiner

*Primary Examiner*—Michael H. Day
(74) *Attorney, Agent, or Firm*—Nixon Peabody LLP; David S. Safran

(57) ABSTRACT

The invention relates to a discharge lamp with a discharge vessel of silica glass which has a higher operating pressure than atmospheric pressure, where the high temperature viscosity (VA) in the outer surface area of the arc tube portion of the discharge vessel is lower than the high temperature viscosity (VB) at a depth of 100 microns from the outer surface of the arc tube portion. Since the high temperature viscosity (VA) in the outer surface area of the arc tube portion of the discharge vessel is lower than the high temperature viscosity (VB) at a depth of 100 microns from the outer surface of the arc tube portion, formation of thermal distortion in the vicinity of the outer surface of the arc tube portion can be suppressed. This prevents the discharge vessel from being damaged or from breaking by thermal distortion even after operation for a long time.

11 Claims, 3 Drawing Sheets

Distortion angle

| | Length of operation (hrs) | | |
|---|---|---|---|
| | 100 | 500 | 1000 |
| Embodiment 1 | 5° | 5° | 0° |
| Embodiment 2 | 10° | 10° | 5° |
| Embodiment 3 | 5° | 0° | 0° |
| Comparison example 1 | ca. 15° | ca. 30° | ca. 40° |

Fig.5

DISCHARGE LAMP WITH LOWER HIGH TEMPERATURE VISCOSITY OUTER PORTION AND METHOD FOR MAKING SAME

BACKGROUND OF THE INVENTION

1. Field of the Invention

The invention relates to a discharge lamp which has a discharge vessel of silica glass and which has an operating pressure higher than atmospheric pressure.

2. Description of Related Art

In a discharge lamp with high radiance such as for example, a super-high pressure mercury lamp, a rare gas-mercury lamp, a metal halide lamp, or the like, a discharge vessel of silica glass is used. Here, the expression "silica glass" is defined as a material which contains $SiO_2$ with a percentage by weight of greater than or equal to 98% and in which greater than or equal to 90 percent by volume is amorphous.

In the operation of one such discharge lamp with high radiance the temperature of the outer surface of the arc tube portion of the discharge vessel reaches 850 to 1000° C. The temperature of the inner surface of the arc tube portion is roughly 50 to 150° C. higher than the temperature of the outer surface. Furthermore, in operation of the discharge lamp, the tube wall of the arc tube portion is exposed to a tensile force due to the internal pressure (operating pressure).

Since when the discharge lamp is operating, the vicinity of the inner surface of the arc tube portion reaches a higher temperature (for example, 900 to 1150° C.) than the vicinity of the outer surface, the glass in the vicinity of the inner surface has a higher viscous flow property than the glass in the vicinity of the outer surface. As a result thereof, when the discharge lamp is turned off, the tensile force exerted on the vicinity of the inner surface of the arc tube portion is reduced by the viscous flow of the glass. The tensile force exerted on the vicinity of the outer surface of the arc tube portion however remains, by which in the vicinity of this outer surface, a tensile load (hereinafter called "thermal distortion") is formed. The thermal distortion in the vicinity of the outer surface of the arc tube portion becomes greater with increasing length of operation. Since cracking in glass forms on the outer surface on which stress corrosion by water occurs, damage and breaking of the discharge vessel are caused as a result.

Therefore, the primary object of the invention is to devise a discharge lamp in which even after operation over a long time, neither damage nor breaking of the discharge vessel occurs due to thermal distortion.

SUMMARY OF THE INVENTION

The object is achieved in accordance with preferred embodiments of the present invention in a discharge lamp as follows:

(1) In one embodiment of a discharge lamp with a discharge vessel of silica glass which has a higher operating pressure than atmospheric pressure, the high temperature viscosity (VA) in the outer surface area of the arc tube portion of the discharge vessel is lower than the high temperature viscosity (VB) of the arc tube portion at a depth of 100 microns from the outer surface.

(2) In another embodiment of a discharge lamp with a discharge vessel of silica glass which has a higher operating pressure than atmospheric pressure, the outer surface area of the arc tube portion of the discharge vessel is subjected to a viscosity reducing treatment.

In the invention, the expression "outer surface area" is defined as an area in the direction of the wall thickness of the tube which forms the arc tube portion, specifically, an area with a depth of 20 microns from the outer surface of the arc tube portion.

The expression "high temperature viscosity" is defined as the coefficient of viscosity which is measured under the condition of a constant temperature of greater than or equal to 850° C. (for example 1200° C.).

The values of the high temperature viscosities (VA) and (VB) to be compared to one another, are values which are determined by measurement under the same temperature condition.

"High temperature viscosity (VB) at a depth of 100 microns from the outer surface" is defined as the value of the high temperature viscosity which is determined by measurement of the "depth from the outer surface—curve of high temperature viscosity".

Furthermore "viscosity reducing treatment" is defined as a treatment for reducing the high temperature viscosity (formation of a layer with reduced viscosity and diffusion of a material with a reduced viscosity).

In the discharge vessel in accordance with the present invention with one such arrangement, the advantages are the following:

(1) Since the high temperature viscosity (VA) in the outer surface area is lower than the high temperature viscosity (VB) at a depth of 100 microns from the outer surface, the glass in the outer surface area during operation of the discharge lamp has a higher viscous flow property than the glass at a depth of 100 microns from the outer surface. As a result, even after the lamp is turned off, in the outer surface area the tensile force is not easily obtained. Therefor, frequent occurrence of thermal distortion is prevented. In the case in which in the outer surface area thermal distortion does not occur, the strength of the silica glass (discharge vessel) can be adequately guaranteed even if in the interior (in an area from a depth of 100 microns to the inner surface), thermal distortion occurs. Thus, formation of damage and breaking of the discharge vessel can be reliably prevented. The reason for this is that cracking of the glass starts primarily proceeding from the outer surface.

(2) Due to the viscosity reducing treatment of the outer surface area of the arc tube portion, the glass in the outer surface area under the temperature condition during operation of the discharge lamp (850 to 1000° C.) has a higher viscous flow property than inside this area.

BRIEF DESCRIPTION OF THE DRAWING

FIG. 5 shows a schematic of the result of measurement of the distortion angle in the outer surface area of the arc tube portion in discharge lamps which were produced by embodiments 1to 3 and comparison example 1, after 100 hours of operation, 500 hours of operation and 1000 hours of operation.

DETAILED DESCRIPTION OF THE INVENTION

Figure 1:
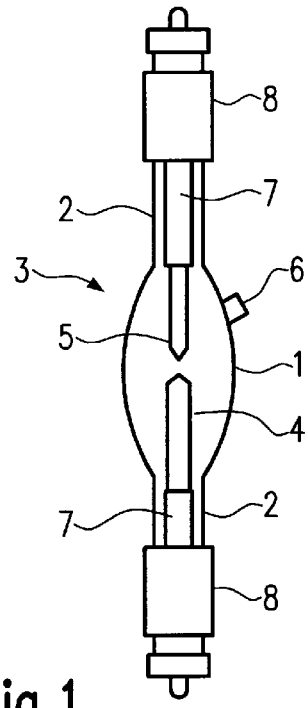
FIG. 1 shows a schematic of one example of a discharge lamp in accordance with the present invention.

FIG. 1 shows a schematic of one example of a discharge lamp in accordance with one embodiment of the present invention which may be a.

The discharge lamp shown in FIG. 1 has a discharge vessel 3 of silica glass which has an arc tube portion 1 and constricted tube portions 2 which are connected to the arc tube portion 1. In the arc tube portion 1, there are a pair of electrodes (anode 4, cathode 5) opposite one another. In the figure, reference number 6 labels the remainder of an outlet tube of the discharge vessel 3. Furthermore, reference number 7 labels a metal foil which is connected to the base of the respective electrode (anode 4, cathode 5) and which is located in the constricted tube portion 2 of the discharge vessel 3'. The reference number 8 labels a base.

Here, the length of the discharge vessel 3 is 30 to 45 mm, the outside diameter of the arc tube portion 1 (the bulb diameter) is 18 to 24 mm, the inside volume of the arc tube portion 1 is 2.0 to 4.6 $cm^3$, the wall thickness of the tube which forms the arc tube portion 1 is 1.5 to 2.5 mm, and the operating pressure of the arc tube portion 1 is 20 to 60 atm.

The feature of the discharge lamp in accordance with the present invention is that the high temperature viscosity in the arc tube portion of the discharge vessel changes according to the depth from the outer surface. Specifically the following conditions must be met:

The high temperature viscosity (VA) in the outer surface area of the arc tube portion 1 is lower than the high temperature viscosity (VB) of this arc tube portion at a depth of 100 microns from the outer surface. This means that the high temperature viscosity increases in the area from the outer surface (with a depth of 0 micron) to a depth of 100 microns in the direction toward the inside.

If here, the value of the ratio (VB/VA) of high temperature viscosity (VB) to high temperature viscosity (VA) is greater than 1, the action of reducing the thermal distortion is obtained, VA and VB being measured under a temperature condition of 1200° C. This value is therefore effective. It has been found to be particularly advantageous for this value to be greater than or equal to 1.12.

To obtain a discharge vessel which meets the above described conditions, it is preferred that a material of natural, water-free silica glass be used as the base material for forming the vessel, that this base material for forming the vessel be subjected to a viscosity reducing treatment, and that thus, the outer surface area of the arc tube portion be formed.

Figure 2:
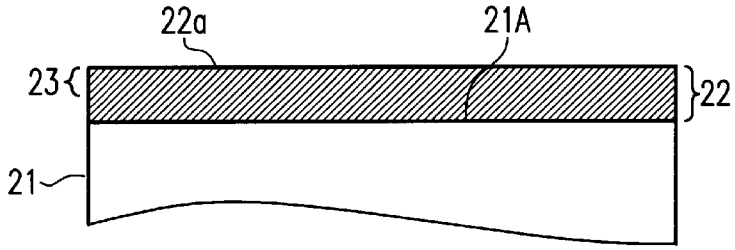
FIG. 2 shows a schematic of the vicinity of the outer surface of the arc tube portion in one example of the discharge vessel of a discharge lamp in accordance with the present invention.

FIG. 2 is a schematic of the vicinity of the outer surface in the arc tube portion 1 in one example of the discharge vessel which is obtained by viscosity reducing treatment of the base material used for forming the vessel.

In the figure, reference number 21 labels a base material for forming the vessel which consists of natural, water-free silica glass. Furthermore, reference number 21A labels the outer surface of the base material 21 for forming the vessel, reference number 22 labels a layer with reduced viscosity which is formed on the outer surface 21A, and reference number 22A labels the outer surface of the layer 22 with a reduced viscosity. This outer surface 22A represents the outer surface of the arc tube portion. Furthermore, reference number 23 labels the outer surface area (area from the outer surface 22A to a depth of 20 microns) of the arc tube portion 1.

It is necessary for the layer with a reduced viscosity 22 to comprise of a material with a lower high temperature viscosity than the high temperature viscosity of the base material 21 for forming the vessel (natural, water-free silica glass). Specifically, it is preferred that it comprises of synthetic, water-free silica glass, alkali silicate glass or the like. The desired thickness of this layer 22 with reduced viscosity is 100 to 500 microns.

Figure 3:
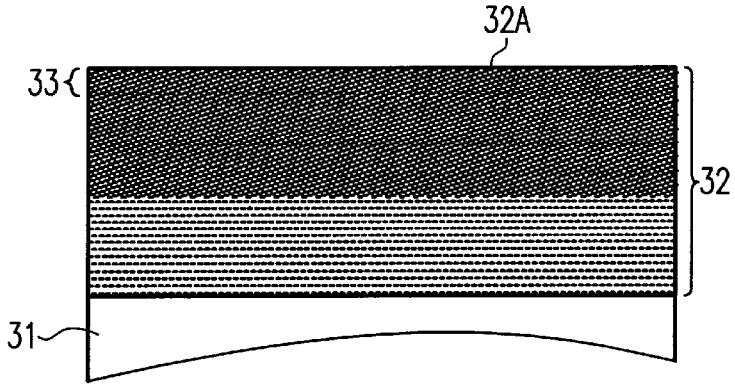
FIG. 3 shows a schematic of the vicinity of the outer surface of the arc tube portion in another example of the discharge vessel of a discharge lamp as claimed in the invention.

FIG. 3 is a schematic of the vicinity of the outer surface in the arc tube portion in another example of the discharge vessel which is obtained by viscosity reducing treatment of the base material used for forming the vessel.

In the figure, reference number 31 labels a base material for forming the vessel which comprises of a natural, water-free silica glass or the like. Furthermore, reference number 32 labels a layer with a reduced viscosity which was formed by diffusion of a material with reduced viscosity in one part (in the vicinity of the outer surface) of the base material 31 for forming the vessel. The outer surface 32A of this layer 32 with reduced viscosity represents the outer surface of the arc tube portion 1. Furthermore, reference number 33 labels the outer surface area (area from the outer surface 32A to a depth of 20 microns) of the arc tube portion 1.

The material for reducing viscosity which comprises the layer 32 with reduced viscosity is selected from materials which can reduce the high temperature viscosity of this silica glass by diffusion into the interior (silica glass) of the base material 31 used for forming the vessel. Specifically, a compound (for example, water) which contains a hydroxyl group, halogen (for a example, chlorine) or the like, may be used.

The layer 32 with reduced viscosity can be formed by one such material for reducing viscosity being diffused to the inside from the outer surface 32A of the base material 31 used for forming the vessel. The layer 32 with reduced viscosity which was formed in this way has a higher concentration of the material for reducing viscosity and a lower high temperature viscosity, nearer to the outer surface 32A. Thus, the varied shading of the layer 32 shown in FIG. 3 schematically illustrates the concentration of the material for reducing viscosity. The desired thickness of this layer 32 with reduced viscosity is 100 to 1000 microns.

In the following, various embodiments of the invention are described. But the invention is not limited thereto. Furthermore, it is described below how the high temperature viscosity (curve of high temperature viscosity) and the thermal distortion of the outer surface of the arc tube portion were measured. (1) Process for measurement of the high temperature viscosity (curve of high temperature viscosity):

In a "micro Vickers sclerometer" with a microscope, the penetrator was replaced by a diamond pyramid with a round tip. According to the principle described in the "Glass Handbook" (Asakura Press 1975), the penetration speed of this penetrator in samples in a nitrogen atmosphere was measured at 1200° C. Based on these measured values, the high temperature viscosity (viscosity coefficient) was computed by the so-called "penetration method". In this way, the change of the high temperature viscosity (curve of high temperature viscosity) was determined with respect to depth from the outer surface (0 to 2000 microns). (2) Process for measuring the thermal distortion of the outer surface of the arc tube portion, Using the change of the polarization angle by anisotropy, a distortion meter "distortion test device" (produced by Toshiba Glass) was used which determines the glass distortion. Thus, the distortion angle in the outer surface area of the arc tube portion of the discharge vessel was measured. This distortion angle is an angle which increases according to the amount of remaining tensile force. It is known from experience that as a result of distortions, cracks often occur when this distortion angle is greater than 40°.

Production Example 1

An oxyhydrogen gas flame into which silicon tetrachloride ($SiCl_4$) was mixed is brought into contact with the surface (21A) of the base material (21) for forming the vessel from natural, water-free silica glass. In this way, silica glass ($SiO_2$) is deposited. Then, the hydroxyl groups were eliminated by 16 hours of degassing of the base material (21) for forming the vessel in a vacuum furnace with 1150° C. In this way, on the surface (21A) of the base material (21) for forming the vessel, the layer (22) with reduced viscosity with a thickness of roughly 50 microns was formed from synthetic, water-free silica glass and a discharge vessel was formed. This discharge vessel has a length of 27 mm, an outside diameter of the arc tube portion of 20 mm, an internal volume of the arc tube portion of 3.5 $cm^3$ and a wall thickness of the tube which forms the arc tube portion of 2.0 mm.

Figure 4A:
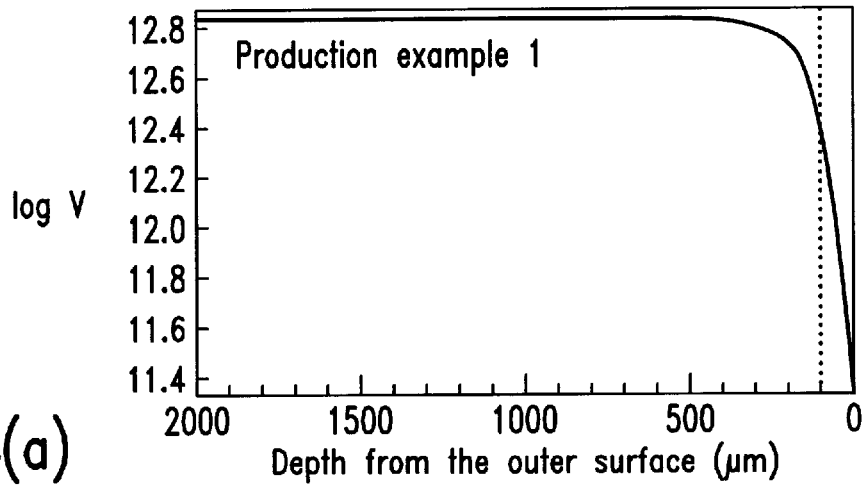
FIGS. 4(*a*) to 4(*c*) each show a curve plot of the high temperature viscosity measured at 1200° C. in the discharge vessels which were obtained in production example 1 to 3; respectively
Figure 4B:
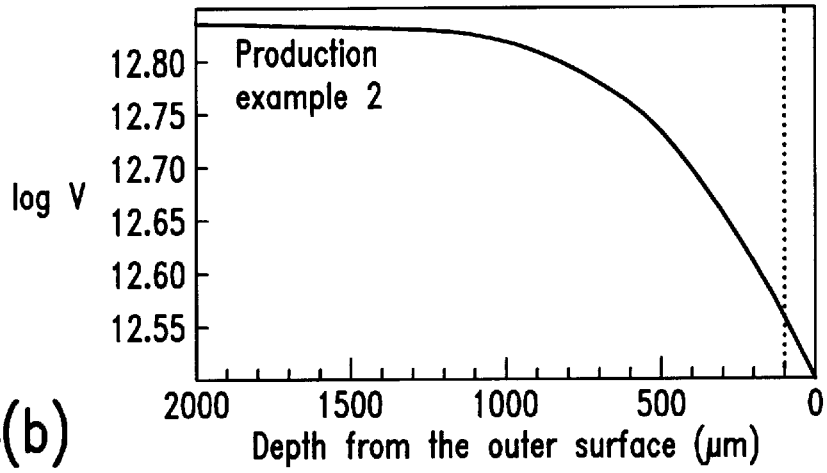
Figure 4C:
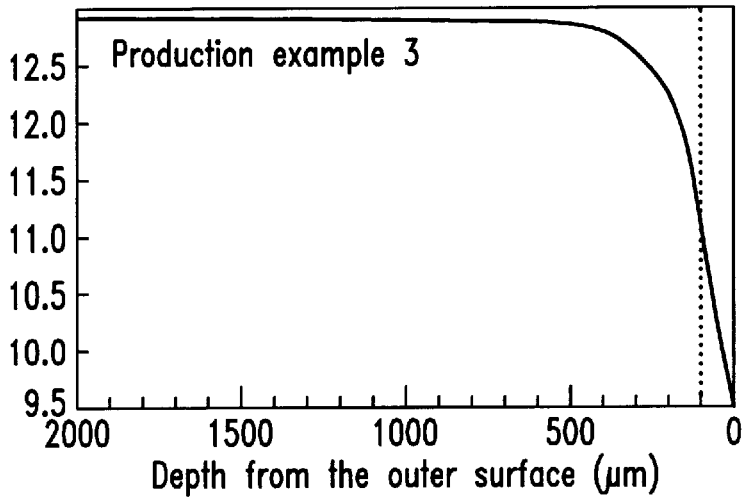

FIG. 4(*a*) shows the curve of the high temperature viscosity measured at 1200° C. in the arc tube portion of the discharge vessel which was obtained. In the curve plots of high temperature viscosity shown in FIG. 4, the numerical values of the x-axis plot the depth from the outer surface of the arc tube portion (0 to 2000 microns). The numerical values of the y-axis represent (log 10 V) the measured high temperature viscosity V (poise).

Production Example 2

The interior of the base material (31) for forming the vessel from natural, water-free silica glass was hermetically sealed in a vacuum. This base material (31) for forming the vessel, together with pure water, was placed in a silica glass ampule which was hermetically sealed with an internal pressure of roughly 2.6 kPa (25° C.) and allowed to remain in the atmosphere with 1100° C. for 16 hours. In this way, in the vicinity (at a depth of roughly 300 microns) of the outer surface of the base material (31) for forming the vessel, a layer (32) with reduced viscosity was formed in which hydroxyl groups are present diffused in. In this way, a discharge vessel with the same shape as the discharge vessel obtained in production example 1 was produced. FIG. 4 (b) shows the curve of the high temperature viscosity measured at 1200° C. in the arc tube portion of this discharge vessel.

Production Example 3

1 percent by volume of alkali silicate glass ($NaO:SiO_2$= 20:80 (mole)) and 99 percent by volume silicon dioxide powder were mixed with one another and a slurry-like composition was produced.

The above described slurry-like composition was applied to the surface (21A) of the base material (21) for forming the vessel from natural, water-free silica glass. The applied film was dried and subjected to burning in by means of a torch. Then the base material (21) for forming the vessel was degassed in a vacuum furnace at 1150° C. for 16 hours. In this way the hydroxy groups were removed. In this way, a layer (22) with reduced viscosity with a thickness of roughly 100 microns of alkali silicate glass (Na concentration: roughly 60 to 100 ppm (weight)) was formed on the surface (21A) of the base material (21) for forming the vessel. Thus, a discharge vessel with the same shape as the discharge vessel obtained in production example 1 was produced. FIG. 4(*c*) shows the curve of the high temperature viscosity measured at 1200° C. in the arc tube portion of this discharge vessel.

Embodiments 1 to 3

Using the discharge vessels which were obtained in the production examples 1 to 3, a super-high pressure mercury lamp with a rated output of 350 W with the arrangement which is shown in FIG. 1 was produced.

Comparison Example 1

Using the base material used in production example 1 for forming the vessel as the discharge vessel a super-high pressure mercury lamp (discharge vessel for comparison purposes) with a rated output of 350 W with the arrangement shown in FIG. 1 was produced.

Evaluation of the Discharge Lamps

The distortion angle in the outer surface area of the arc tube portion was measured in the discharge lamps which were obtained by embodiments 1 to 3 and the comparison example 1 after 100 hours of operation, 500 hours of operation and 1000 hours of operation. FIG. 5 shows the results.

As operation was continued, and operating length of 1200 hours was reached, cracks formed on the outer surface of the arc tube portion of the discharge lamp in comparison example 1.

In the discharge lamps which were obtained in embodiments 1 to 3, no cracking was recognized on the outer surface of the arc tube portion.

The following effects are obtained by the discharge lamp in accordance with the present invention:

(1) In a discharge lamp with a discharge vessel of silica glass which has a higher operating pressure than atmospheric pressure, the high temperature viscosity (VA) in the outer surface area of the arc tube portion of the discharge vessel is lower than the high temperature viscosity (VB) at a depth of 100 microns from the outer surface of the arc tube portion. By this measure, formation of thermal distortion in the vicinity of the outer surface of the arc tube portion can be suppressed. This prevents the discharge vessel from being damaged or from breaking by thermal distortion even after operation for a long time.

(2) In a discharge lamp with a discharge vessel of silica glass which has a higher operating pressure than atmospheric pressure, the outer surface area of the arc tube portion of the discharge vessel is subjected to viscosity reducing treatment.

Formation of thermal distortion in the vicinity of the outer surface of the arc tube portion can be suppressed by this measure. Therefore, the discharge vessel is prevented from being damaged or from breaking by thermal distortion even after operation for a long time.

I claim:

1. A discharge lamp comprising a discharge vessel consisting essentially of water-free silica glass which is operable at an operating pressure higher than atmospheric pressure, said discharge vessel of water-free silica glass including an arc tube section comprising, an outer portion which extends from an outer surface of the arc tube section of the discharge vessel into the arc tube section to a depth of less than 100 microns and which includes hydroxyl groups, and an inner portion, wherein said outer portion has a high temperature viscosity which is lower than a high temperature viscosity at a depth of greater than 100 microns from the outer surface.

2. A discharge lamp of claim 1, wherein said outer surface of said arc tube section of the discharge vessel has been subjected to a viscosity reducing treatment thereby producing the high temperature viscosity within the outer portion which is lower than the high temperature viscosity of the inner portion.

3. A discharge lamp comprising a discharge vessel consisting essentially of water-free silica glass material, which is operable at an operating pressure higher than atmospheric pressure, and said discharge vessel includes an arc tube section which comprises, an outer portion of a first high temperature viscosity extending from an outer surface of the discharge vessel and an inner portion of a second high temperature viscosity, wherein said first high temperature viscosity is lower than said second high temperature viscosity, and wherein a viscosity reducing material having been diffused into the outer portion of the vessel wall by a process comprising the steps of, hermetically sealing the interior of the discharge vessel in a vacuum, and heating the discharge vessel at an elevated temperature and pressure in the presence of water for sufficient time to cause hydroxyl groups to be diffused into the outer portion of the vessel wall.

4. A discharge lamp of claim 3, wherein said outer portion of the first high temperature viscosity extends to a depth of 100 microns from the outer surface of said vessel wall.

5. A process of manufacturing a discharge lamp, which is operable at an operating pressure higher than atmospheric pressure, comprising a discharge vessel in which said discharge vessel includes an arc tube section consisting essentially of water-free silica glass material wherein said arc tube section includes an outer portion of a first high temperature viscosity extending from an outer surface of the vessel wall and an inner portion of a second high temperature viscosity, the process comprising the steps of:

hermetically sealing the interior of the discharge vessel in a vacuum, and heating the discharge vessel at an elevated temperature and pressure in the presence of water for sufficient time to cause hydroxyl groups to be diffused into the outer portion of the vessel wall.

6. A discharge lamp comprising a discharge vessel which is operable at an operating pressure higher than atmospheric pressure, said discharge vessel including an arc tube section comprising, an outer portion comprising a diffused region which extends from an uncoated outer surface of the arc tube section of the discharge vessel into the arc tube section to a depth of less than 100 microns, and an inner portion, wherein said outer portion has a high temperature viscosity which is lower than a high temperature viscosity of said inner portion at a depth of greater than 100 microns from the outer surface.

7. A discharge lamp of claim 6, wherein said uncoated outer surface of said arc tube section of the discharge vessel has been subjected to a viscosity reducing treatment of the uncoated outer surface of the arc tube section thereby producing the high temperature viscosity within the outer portion which is lower than the high temperature viscosity of the inner portion.

8. A discharge lamp comprising a discharge vessel which is operable at an operating pressure higher than atmospheric pressure, and said discharge vessel includes an arc tube section which comprises, an outer portion of a first high temperature viscosity extending from an uncoated outer surface of the discharge vessel and an inner portion of a second high temperature viscosity, wherein said first high temperature viscosity is lower than said second high temperature viscosity, and wherein a viscosity reducing material having been diffused into the outer portion of the vessel wall by a process comprising the steps of, providing a discharge vessel having an arc tube section of a second high temperature viscosity, diffusing a viscosity reducing material capable of reducing the high temperature viscosity of the arc tube section into the outer surface of the arc tube section to form said outer portion of said first high temperature viscosity in the arc tube section.

9. A discharge lamp of claim 8, wherein said outer portion of the first high temperature viscosity extends to a depth of 100 microns from the outer surface of said vessel wall.

10. A process of manufacturing a discharge lamp, which is operable at an operating pressure higher than atmospheric pressure, comprising a discharge vessel in which said discharge vessel includes an arc tube section wherein said arc tube section includes an outer portion of a first high temperature viscosity extending from an uncoated outer surface of the vessel wall and an inner portion of a second high temperature viscosity, the process comprising the steps of:

providing a discharge vessel having an arc tube section of a second high temperature viscosity, diffusing a viscosity reducing material capable of reducing the high temperature viscosity of the arc tube section into the outer surface of the arc tube section to form said outer portion of said first high temperature viscosity in the arc tube section.

11. The process of claim 10, wherein the diffusing step is performed to form said outer portion of the first high temperature viscosity to a depth of 100 microns from the outer surface of said vessel wall.

* * * * *